US010470639B2

(12) United States Patent
Polti et al.

(10) Patent No.: US 10,470,639 B2
(45) Date of Patent: Nov. 12, 2019

(54) CLEANING DEVICE

(71) Applicant: POLTI SPA, Bulgarograsso Como (IT)

(72) Inventors: Francesca Polti, Bulgarograsso Como (IT); Stefano Cappi, Bulgarograsso Como (IT)

(73) Assignee: POLTI SPA, Bulgarograsso Como (IT)

( * ) Notice: Subject to any disclaimer, the term of this patent is extended or adjusted under 35 U.S.C. 154(b) by 60 days.

(21) Appl. No.: 15/554,293

(22) PCT Filed: Feb. 19, 2016

(86) PCT No.: PCT/EP2016/053582
§ 371 (c)(1),
(2) Date: Aug. 29, 2017

(87) PCT Pub. No.: WO2016/139074
PCT Pub. Date: Sep. 9, 2016

(65) Prior Publication Data

US 2018/0035862 A1 Feb. 8, 2018

(30) Foreign Application Priority Data

Mar. 3, 2015 (IT) ..... LO2015A0003

(51) Int. Cl.
*A47L 7/00* (2006.01)
*A47L 13/257* (2006.01)
(Continued)

(52) U.S. Cl.
CPC ..... *A47L 13/257* (2013.01); *A47L 13/225* (2013.01); *A47L 13/50* (2013.01)

(58) Field of Classification Search
CPC ..... A47L 13/50; A47L 13/58–60; A47L 13/225–257
(Continued)

(56) References Cited

U.S. PATENT DOCUMENTS 6,065,182 A 5/2000 Wright et al.
2009/0007351 A1* 1/2009 Horian ..... A47L 13/254 15/104.001
(Continued)

FOREIGN PATENT DOCUMENTS

EP 2586351 A1 5/2013
WO 97/49327 12/1997
(Continued)

OTHER PUBLICATIONS

International Search Report received in the corresponding International Application No. PCT/EP2016/053582, dated Jun. 7, 2016.

*Primary Examiner* — Joseph J Hail
*Assistant Examiner* — Shantese L McDonald
(74) *Attorney, Agent, or Firm* — Kilpatrick Townsend & Stockton LLP

(57) ABSTRACT

The invention relates to a device for cleaning planar surfaces such as floors, walls, ceilings, countertops, glasses, in particular for floors cleaning, comprising a mop and an external base station, wherein the external base station comprises a reservoir of cleaning fluid and it supplies said cleaning fluid to said mop, when the mop is in contact with a section of the base station. In a preferred embodiment the cleaning fluid is water and the device comprises a heating element is adapted to vaporize the cleaning fluid which is released through the one or more nozzles in the form of steam.

14 Claims, 9 Drawing Sheets

(51) Int. Cl.
*A47L 13/50* (2006.01)
*A47L 13/22* (2006.01)

(58) Field of Classification Search
USPC ..... 15/105, 115, 118, 320
See application file for complete search history.

(56) References Cited

U.S. PATENT DOCUMENTS

| | | | | |
|---|---|---|---|---|
| 2009/0265871 | A1* | 10/2009 | Wooten | A47L 13/20 15/119.1 |
| 2011/0203613 | A1* | 8/2011 | Roberts | A47L 13/58 134/10 |
| 2012/0222227 | A1* | 9/2012 | Johnson | A47L 11/4002 15/105 |
| 2015/0182094 | A1* | 7/2015 | Brain | A47L 13/59 15/119.1 |

FOREIGN PATENT DOCUMENTS

| | | | |
|---|---|---|---|
| WO | 2007/047792 | A2 | 4/2007 |
| WO | 2012/018293 | A1 | 2/2012 |

* cited by examiner

CLEANING DEVICE

This application is the U.S. National Stage application of International application No. PCT/EP2016/053582, filed Feb. 19, 2016, which claims priority to Italian Patent Application no. LO2015A000003, filed Mar. 3, 2015. The entirety of each of these applications is incorporated herein by reference.

FIELD OF THE INVENTION

The invention relates to a device for cleaning planar surfaces such as floors, walls, ceilings, countertops, glasses, in particular for floors cleaning, comprising a mop and an external base station, wherein the external base station comprises a reservoir of cleaning fluid and it supplies said cleaning fluid to said mop, when the mop is in contact with a section of the base station.

BACKGROUND OF THE INVENTION

Floors cleaning is typically performed by sweeping or vacuuming the surface, thereby wiping it with a wet cloth; the wet cloth is pushed on the floor and the dirty surface is rubbed. The cloth is generally dragged on the floor by means of a mop, which mop comprises a handle and a plate or brush at the end of said handle.

A cleaning fluid, preferably hot water or a moisture of water and detergents, is usually contained in a bucket and the cloth is soaked into it. After soaking the cloth, the fluid adsorbed in excess must be squeezed out of the cloth, generally by hand. Said steps are repeated several times during cleaning: the cloth must be continuously soaked into the fluid, in order to remove dirt and soil collected from the domestic surface and to rinse it again. Furthermore, when the cleaning fluid is too dirty to rinse the cloth, it must be replaced with fresh fluid. The use of cloths is thus uncomfortable in view of said inevitable steps and the time needed for completing the floor cleaning can be long.

Currently, the most evolved systems make use of mops wherein the head consists in a bundle of coarse strings or yarns, attached to the handle. Said systems are handier than traditional mops, however they are not devoid of deficiencies. First, they cannot impart to the floor the same mechanical force of traditional mops with plates or brushes. Consequently, more detergent is needed for efficiently removing dirt. Furthermore, the step of repeatedly soaking into the cleaning fluid the head of the mop and the step of replacing the fluid in the bucket when it gets too dirty are still required. Several systems have been developed in order to optimize the squeezing of the wet head, without using hands, however it is still very difficult to efficiently remove the excess of liquid adsorbed by the head, thus the time needed for completing the cleaning is still long. Moreover, much dirt remains entrapped in the yarns of the mop heads and complete dryness of the same is rarely achieved after use, leading to bad smell and possibly to cross-infections (which may be very harmful especially in certain environments, such as hospitals).

US2009265871A1 discloses a device comprising a mop with a head made of a plurality of mopping strands and a bucket for detergent fluids, into which the mop is soaked, which comprises heating elements for heating said fluids. Said system may reduce the amount of detergents employed, as the cleaning fluid is warmed up, however it does not solve the problem of avoiding the steps of repeatedly soaking and squeezing the head, nor the step of replacing the dirty cleaning fluid during use.

Besides using hot fluids, when a deeper and more complete cleaning is desired, it is very advantageous to employ a steam cleaner. The use of high temperature steam is in fact very efficient in removing dirt and grime embedded on the surfaces.

In order to provide steam on the surface to be cleaned, conventional steam cleaners comprise a tank filled with water which is constantly heated to generate steam. Steam cleaners comprise a steam generator, e.g. a boiler, which converts electric energy into heat and generates steam from the water contained within. Clearly, the presence of a boiler to be carried over while cleaning makes conventional steam cleaners very unhandy; furthermore, electric energy is usually provided by means of electric current, thus requiring the steam cleaner to be plugged in electrical outlets through a cord, when in use.

The same problems are faced when using devices which, instead of steam, dispense detergent fluids on the floor: the detergent fluid is generally contained in a tank, which is part of the mop and it is thus carried over while cleaning. The fluid can be dispensed manually or automatically. When using manual dispensers, there is the risk of dispensing cleaning fluids in excess, which requires longer time for rinsing and/or drying the surface; automatic release of fluid is more convenient, however it generally requires the device to be connected to an electric outlet.

Cordless devices, operated by batteries, capable of dispensing cleaning fluids, also exist. However, said devices still have drawbacks: they must be charged before use and the cleaning fluid is contained in a tank which is carried over during cleaning. A cordless device for cleaning floors, comprising a tank for detergent fluids is disclosed in U.S. Pat. No. 6,065,182A. The fluid is conveyed directly on the floor while cleaning and a suction hose draws dirty liquid from the floor. The device is bulky and heavier than a traditional mop.

WO2007047792 discloses a hand-held steam cleaning device, which can be used "cordless": a power base station, working in conjunction with a steam pressure vessel, can eliminate the limitations of a power cord and keep the vessel enclosure, water and steam at the proper temperature. The vessel enclosure, water and steam can be easily reheated for continued use by placing the pressure vessel on a vessel plug located on a support plate of the power base station. The cordless device of WO2007047792 is convenient, as the user is not constrained by the electric connection to a plug, however said device is not a mop and it is only suitable for spot cleaning or cleaning relatively small areas. Furthermore, the pressure vessel containing the liquid is part of the hand-carry device, therefore the user still has to carry it over while using the device.

The present invention is directed to a cleaning device, in particular for cleaning planar surfaces, such as floors or walls, comprising a mop, wherein the mop head is supplied with cleaning fluid by means of an external base station. The cleaning fluid is supplied in controlled amount when the mop is in contact with said external base station; once supplied with the cleaning fluid, the mop is ready to be used and it is detached from the base station.

The present invention overcomes all the drawbacks of the mops currently available on the market. It is in fact a handy and light device; it provides the efficient rubbing force of the traditional mops with plate heads, while avoiding dealing with wet cloths and buckets, making thus the cleaning less time consuming. Furthermore, being automatically supplied with a controlled dose of cleaning fluid, it avoids the risk of dispensing cleaning fluids in excess, which would be difficulty washed away. Also, as the cleaning fluid is dispensed on the mop from a separated reservoir, the mop is handier and lighter than devices wherein the cleaning fluid's reservoir is carried over during cleaning. The use of steam as the cleaning fluid presents the advantage of sanitizing the surface and limiting the risks of cross-infection.

DETAILED DESCRIPTION OF THE INVENTION

Figure 1:
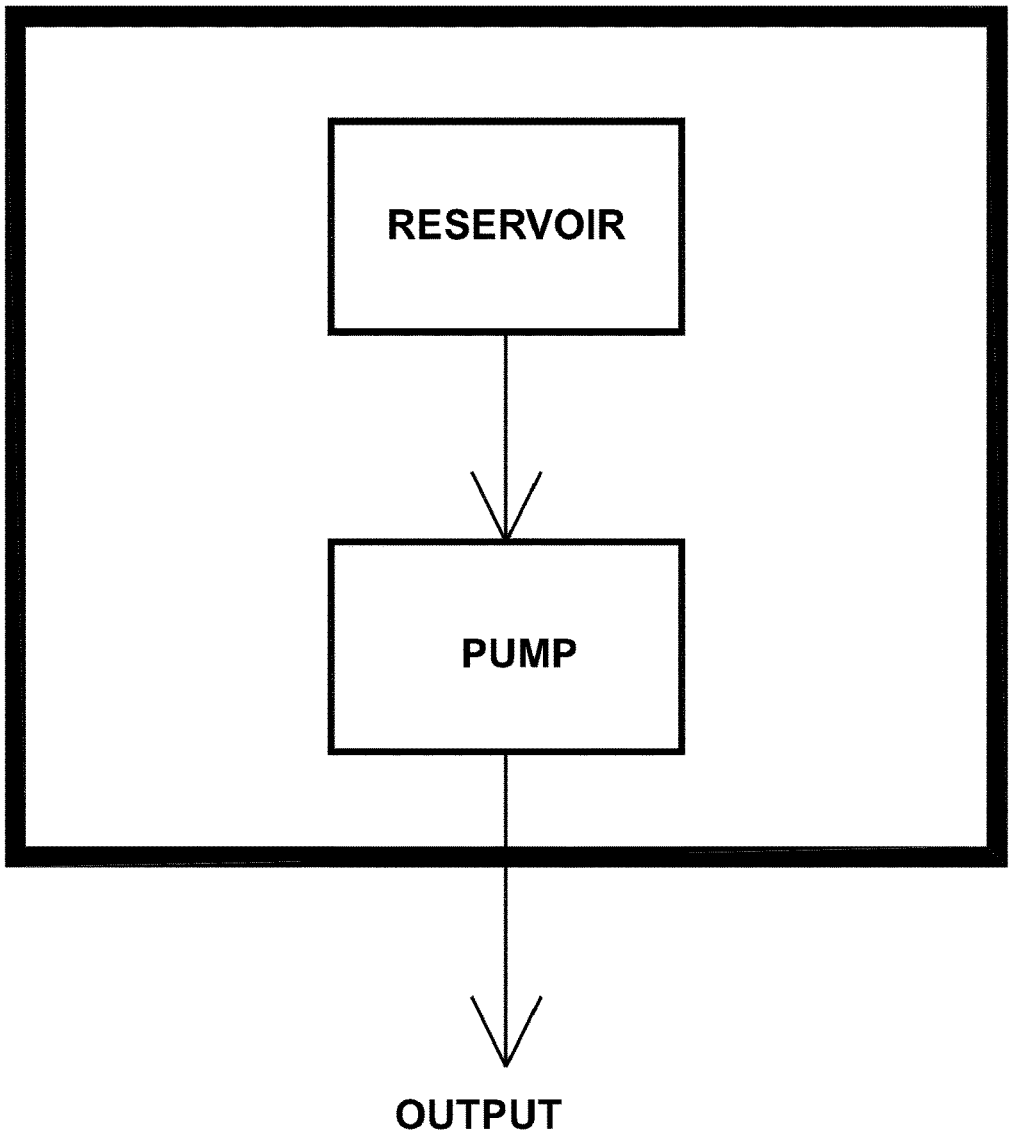
FIG. 1 discloses an embodiment of the external base station comprising a reservoir and a pump for dosing the cleaning fluid.

The present invention relates to a cleaning device for cleaning planar surfaces, preferably floors, comprising a mop and an external base station adapted to support said mop; the mop comprises a handle and a head, preferably a plate head; the external base station comprises a base section, preferably a flat section, adapted to contact at least a portion of the mop head, and a reservoir, containing a cleaning fluid; said base section of the external base station further comprises one or more nozzles through which at least a portion of the cleaning fluid is released and supplied to the mop head, when the mop head is in contact with base section of the external base station. Preferably, the external base station further comprises a dispenser which doses a predetermined amount of cleaning fluid to be released through the one or more nozzles.

The term "external base station" is thus herein employed to define an apparatus comprising a housing (base section) adapted to support the head of a mop, a reservoir for containing a cleaning fluid and a one or more nozzles for dispensing at least a portion of said cleaning fluid.

According to the present invention, the external base station is preferably operated by connecting it to electric outlets; the mop of the invention is cordless. Optionally, the external base station can comprise a set of rechargeable batteries. In this way, the apparatus can be used even in the absence of a plug to connect to electrical power and have enough autonomy to clean at least 100 $m^2$ of surface, preferably at least 200 $m^2$ of surface.

Preferably, when power is supplied to the external base station, the base station is in stand-by mode, until the mop head is placed in contact with the base section; said contact activates the base station and the cleaning fluid is released through the nozzles and supplied to the mop head. Preferably, the base station is activated when the mop head is placed on the base section. Activation of the base can take place in different ways, e.g. a reed sensor, an infrared sensor, a capacitive sensor, a radiofrequency system, an automatic sensor. The cleaning fluid is then released in response of said activation. Alternatively, or additionally, the base can be activated manually, e.g. through a switch, a handle or a tap.

The term "stand-by mode" indicates that power is supplied to the external base station, but the cleaning fluid is not released and/or heating element is not activated.

After the cleaning fluid has been supplied to the mop head, the mop is ready to be used for cleaning and is detached from the external base station.

When cleaning is finished, the mop can be placed again on the base section of the external base station; optionally the cleaning fluid can be released in response of the contact of the mop head with the base section; optionally, if the mop is not detached further and is kept in contact with the base station for a predetermined time, for example at least 5 minutes, the external base station turns into stand-by mode.

The device of the invention can thus have a "charge status", wherein the mop is supported on the external base station with at least a portion of said mop head in contact with said base section, and wherein the cleaning fluid is supplied to the mop head, or a "use status", wherein the mop has been supplied with the cleaning fluid and it is detached from the external base station, and "a rest status" wherein the mop is supported on the external base station with at least a portion of said mop head in contact with said base section and wherein no cleaning fluid is supplied to the mop head.

Preferably, the cleaning device of the invention further comprises a cloth, which is applied to the head of the mop: when the cleaning fluid is supplied to the mop by the external base station, it is adsorbed by the cloth applied to the head of the mop. Preferably the cloth is a single use cloth; more preferably, the cloth is of a biodegradable material; most preferably, the cloth is made of microfiber.

The cleaning fluid contained in the reservoir of the external base station, optionally a heated cleaning fluid, is preferably water and/or a detergent fluid.

Figure 2:
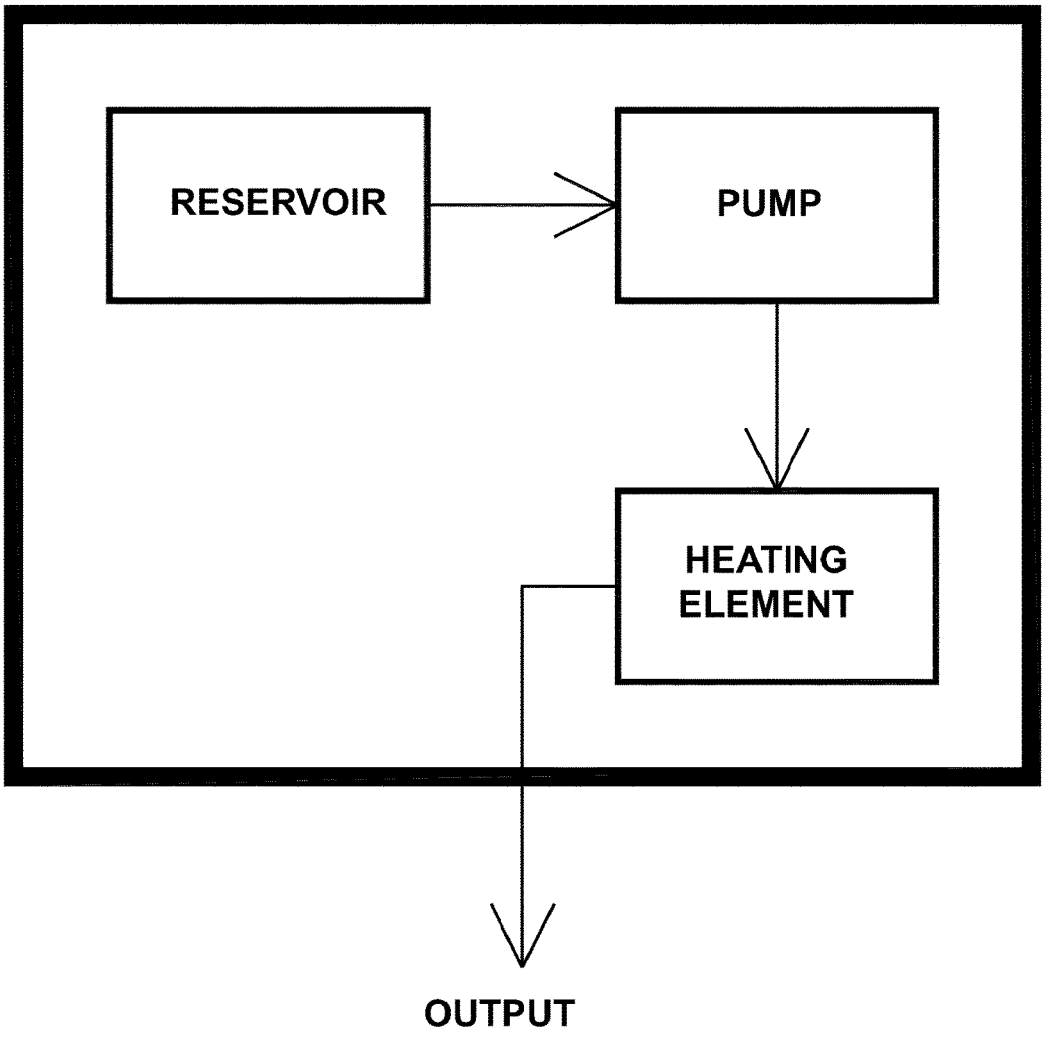
FIG. 2 discloses another embodiment of the external base station further comprising a heating element after the pump.
Figure 3:
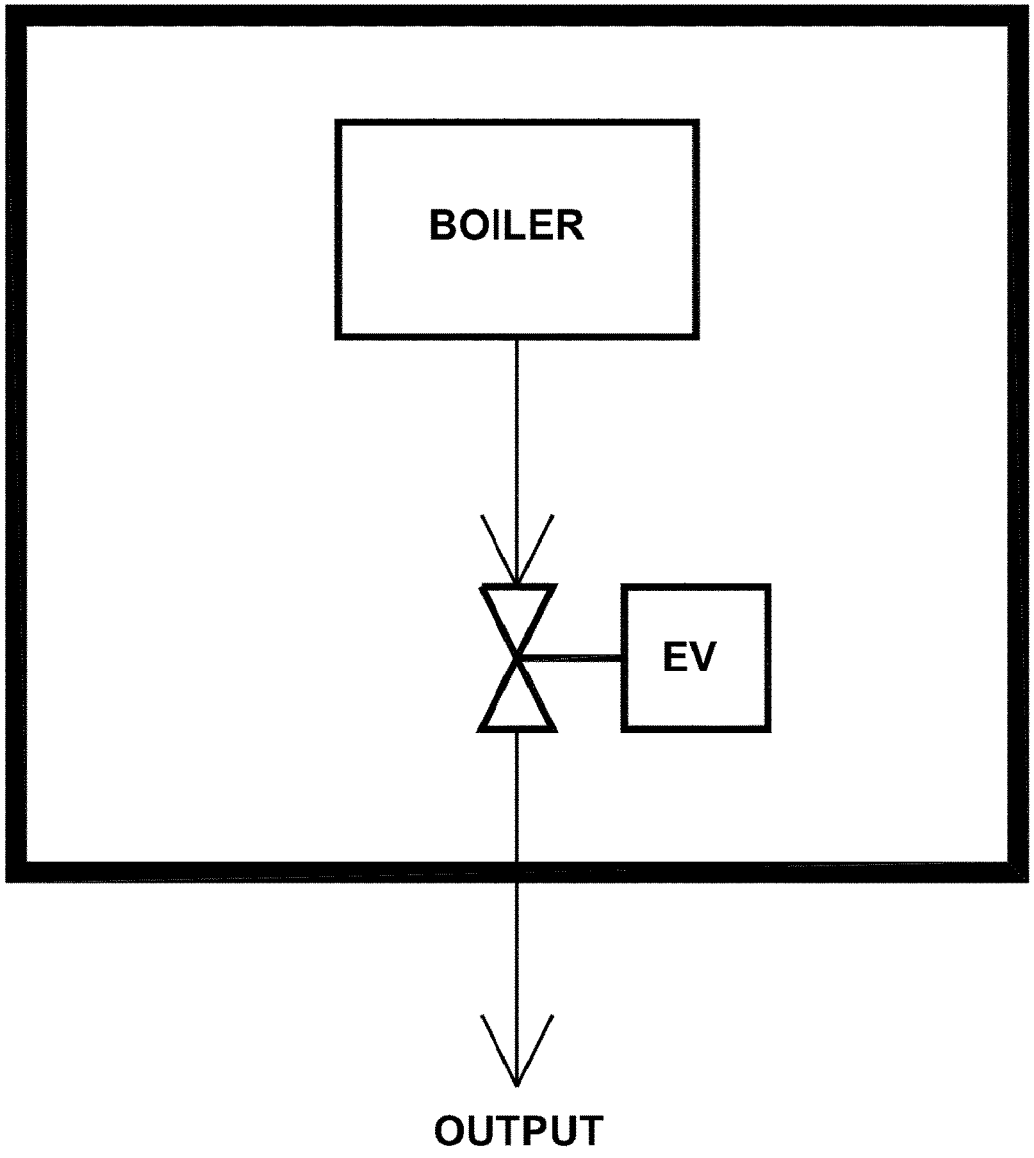
In FIG. 3 the heating element is present inside the reservoir, i.e. the reservoir is a boiler. The base also comprises an electro valve for dosing the heated fluid, preferably steam.
Figure 4:
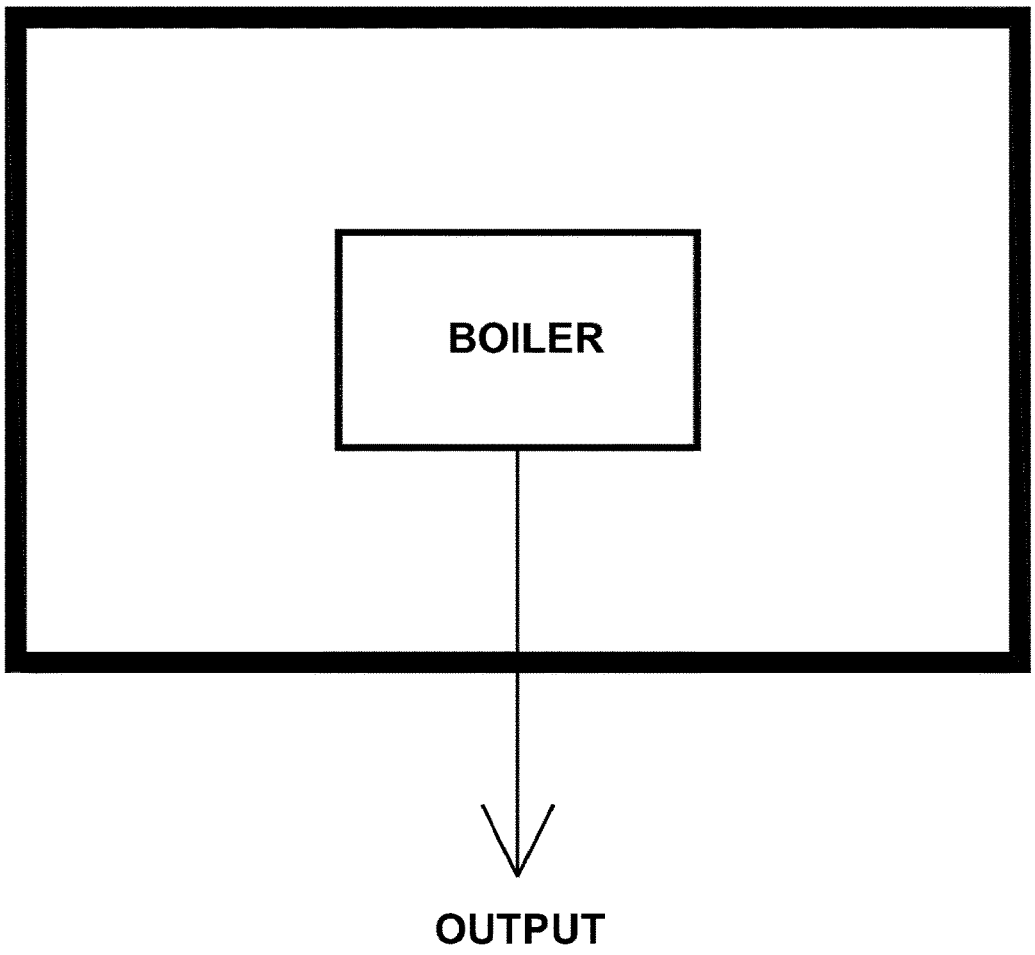
In FIG. 4 the base comprises a boiler which directly dispenses the heated fluid, preferably steam, on the mop.
Figure 5:
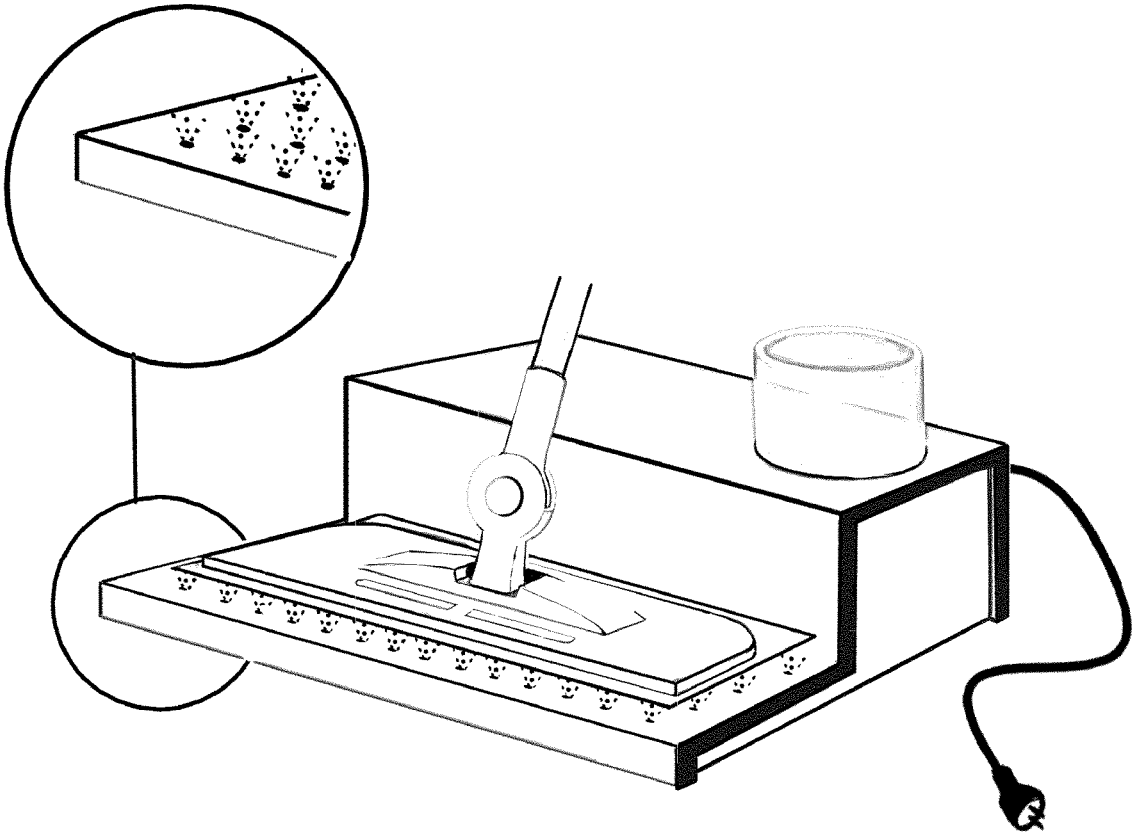
FIG. 5 is a view of the apparatus and shows an enlargement of the base with a plurality of nozzles.
Figure 6:
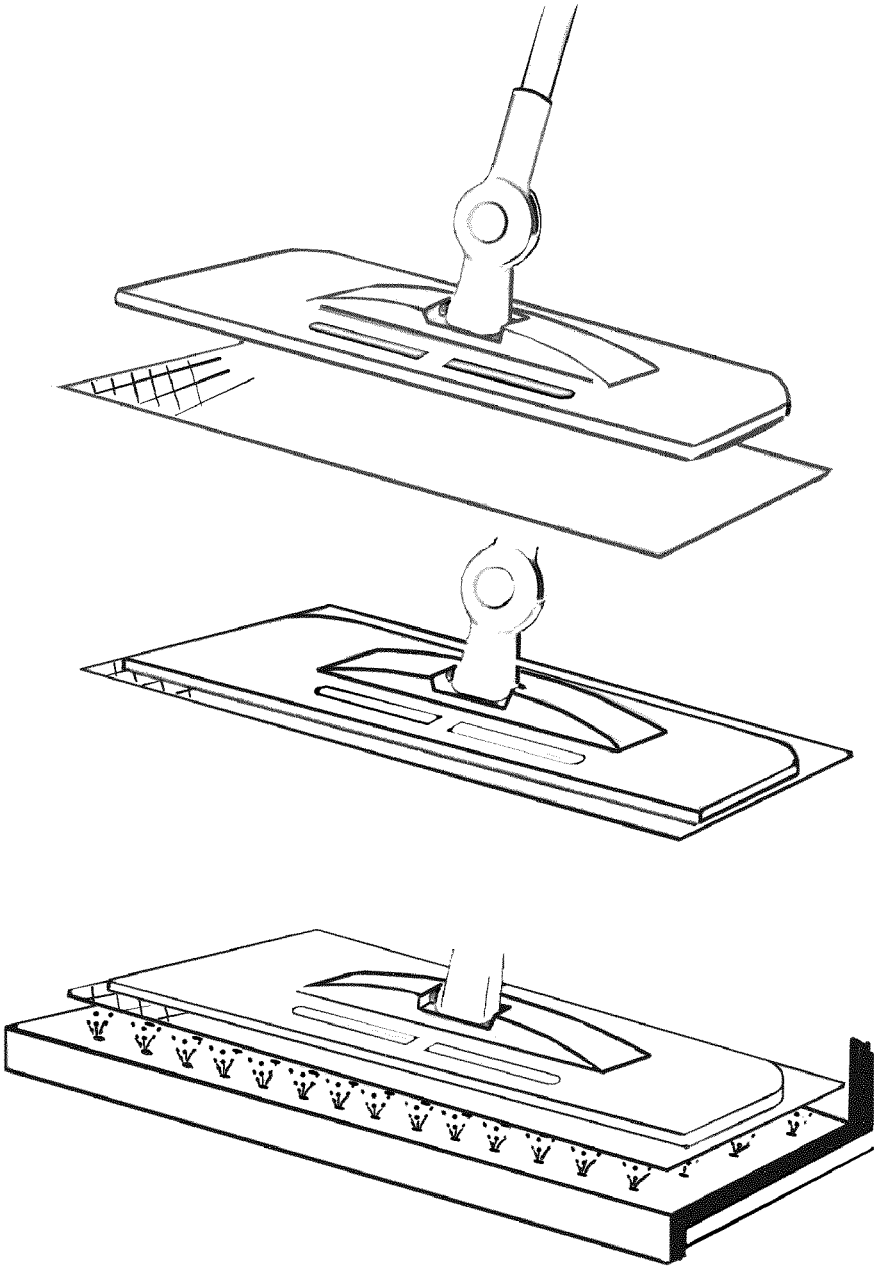
FIG. 6 shows how the mop head and the cloth are combined and then placed on the base.
Figure 7:
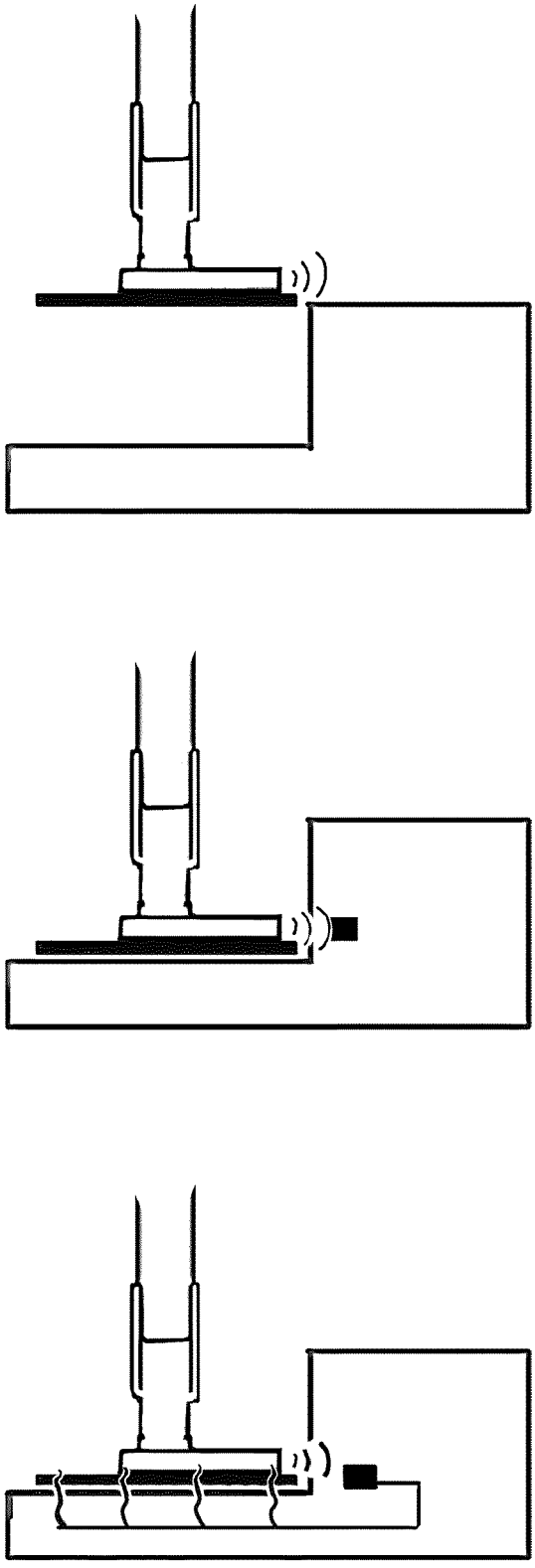
FIG. 7 Shows an exemplary system for activating the system when the mop head is placed on the base.
Figure 8:
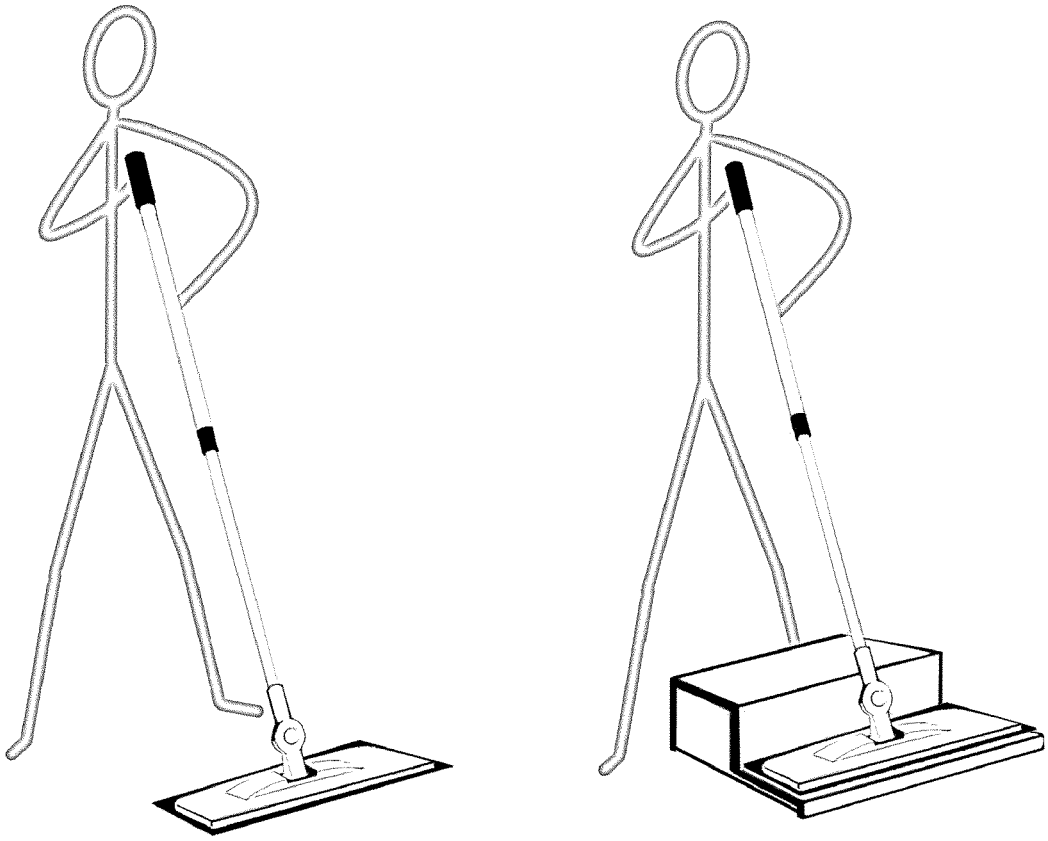
FIG. 8 shows the mop when placed over the base and in use.
Figure 9:
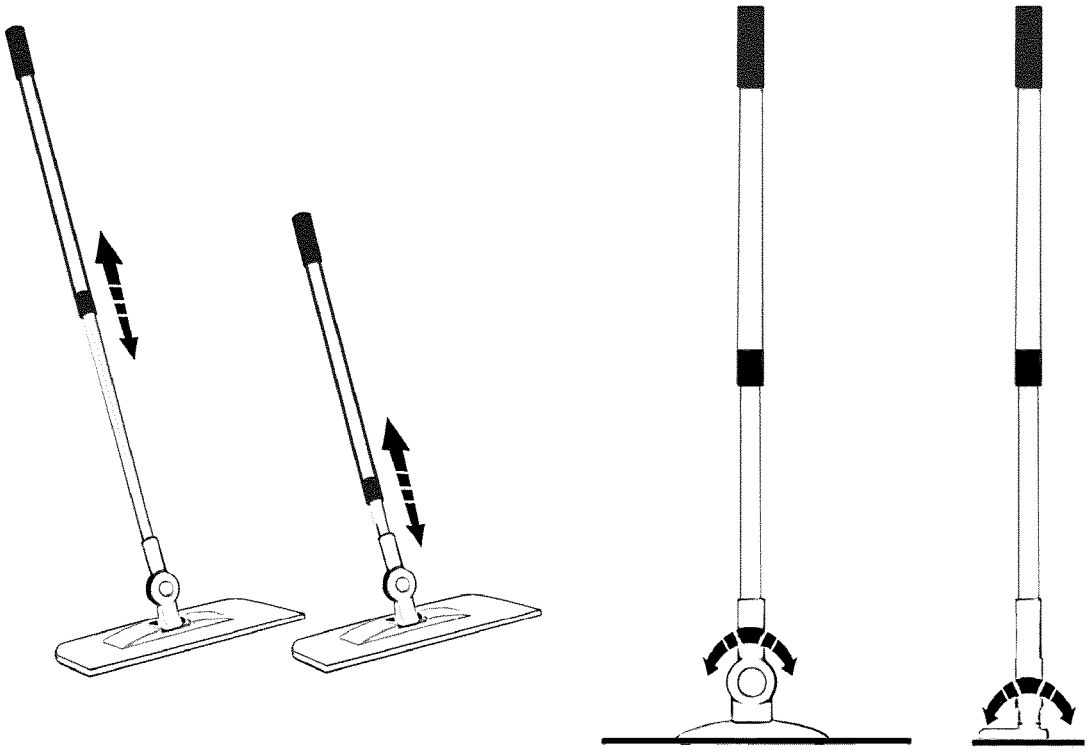
FIG. 9 shows a preferred embodiment wherein the handle of the mop is telescopic and wherein the handle can rotate relative to the head to make easier the use of the mop during cleaning.

According to a preferred embodiment of the invention, the cleaning device comprises a heater which is adapted to warm up the cleaning fluid; more preferably, the cleaning fluid is water and it is vaporized by means of the heater, so that it is released through the at least one nozzle in the form of steam. FIGS. 1-4 show different systems which can be used for delivering and optionally heating the cleaning fluid.

Preferably, the external base station comprises a dispenser which doses the amount of cleaning fluid to be supplied to the mop head; in this way the amount of cleaning fluid can be predetermined and controlled so that the mop does not carry over excessive fluid and the cleaned surface is dried within convenient time. Preferably, the external base station comprises an electronic board, configured to control the dispenser and/or the heater. For example, the amount of cleaning fluid to be supplied can be determined on the basis of an algorithm which is processed by an electronic board's software.

Preferably, the mop head comprises a material, more preferably a metallic material, which is capable of accumulating heat supplied by the external base station and to release said heat on the surface to be cleaned while the mop is rubbed on it. This is very advantageous as it allows to perform deep cleaning even in the absence of detergents.

Preferably, the mop head is connected to the handle by means of a universal joint, such as a gimbal. The universal joint improves the maneuverability of the mop.

According to a preferred embodiment of the present invention, at least one of the mop head and the external base station comprises visual or acoustic means for indicating when the mop is ready to be used for cleaning; preferably, said means are temperature indicators. For example, the temperature indicators may indicate that the cleaning fluid has been released on the mop or that the cleaning fluid has been sufficiently heated, thereby indicating that the mop is ready to be used. In another preferred embodiment, the mop comprises visual or acoustic means adapted to indicate when the mop needs to be charged again with the cleaning fluid, by being placed in contact with the external base station.

Preferably, the device of the present invention is capable of cleaning a surface of about 25 $m^2$ after each charge of cleaning fluid.

According to a preferred embodiment, when the user has finished to use the mop, the mop is placed on the base station and the cleaning fluid is released in order to sanitize the mop head.

Preferably, when the mop is in contact with the base station for a time greater than 5 minutes, more preferably greater than 10 minutes or greater 20 minutes, after the cleaning fluid has been released, the external base station is turned into a stand-by mode.

Preferably, the mop handle is a telescopic handle. A telescopic handle allows to adapt the height of the mop handle during use to the height of the user; furthermore, it can be employed to reduce the height of the mop handle when the mop is stored away, reducing thus the room needed for storing.

The invention claimed is:

1. A device for cleaning planar surfaces comprising:

a mop comprising a handle, and a head; and an external base station comprising a base section, adapted to support said mop and to contact at least a portion of the mop head, and a reservoir, which contains a cleaning fluid;

wherein said base section further comprises one or more nozzles, through which at least a portion of said cleaning fluid is released and supplied to the mop head when the mop head is in contact with said base section of the external base station;

wherein the external base station comprises a power supply and a heating element operated by said power supply, and wherein the heating element is adapted to warm up the cleaning fluid when the at least a portion of the mop head is in contact with said base section.

2. The device of claim 1, wherein the handle is a telescopic handle.

3. The device of claim 1, wherein the head is a plate head, and the base section is a flat base section.

4. The device of claim 1, wherein the reservoir is a removable reservoir.

5. The device of claim 1, adapted to have a charge status, wherein the mop is supported on the external base station with the at least a portion of said mop head in contact with said base section and wherein the cleaning fluid is supplied to the mop head; a use status, wherein the cleaning fluid has been supplied to the mop and the mop is detached from the external base station; and a rest status wherein the mop is supported on the external base station with the at least a portion of said mop head in contact with said base section and wherein no cleaning fluid is supplied to the mop head.

6. The device of claim 1, wherein the external base station comprises a dispenser for dosing the at least a portion of cleaning fluid which is released through the one or more nozzles.

7. The device of claim 6, wherein the external base station comprises an electronic board configured to control said dispenser.

8. The device of claim 1, further comprising a cloth, which cloth is applied to the head of the mop, so that the at least a portion of said cleaning fluid released through the one or more nozzles is adsorbed by the cloth.

9. The device of claim 1, wherein the cleaning fluid is water and the heating element is adapted to vaporize the cleaning fluid which is released through the one or more nozzles in the form of steam.

10. The device of claim 1, wherein the mop head comprises a metallic material.

11. The device of claim 1, wherein at least one of the mop head and the external base station comprises a visual or acoustic indicator for indicating that the mop is ready to be used for cleaning.

12. The device of claim 11 wherein said visual or acoustic indicator are temperature indicators.

13. The device of claim 1, wherein the mop head is connected to the handle by a universal joint.

14. The device of claim 13, wherein the universal joint is a gimbal.

* * * * *